United States Patent [19]

McCaughey

[11] 3,969,806

[45] July 20, 1976

[54] APPARATUS AND METHOD FOR CRIMPING TERMINALS

[75] Inventor: William S. McCaughey, Naperville, Ill.

[73] Assignee: Bunker Ramo Corporation, Oak Brook, Ill.

[22] Filed: Nov. 21, 1974

[21] Appl. No.: 525,900

Related U.S. Application Data

[63] Continuation of Ser. No. 333,630, Feb. 20, 1973, abandoned.

[52] U.S. Cl. ..... 29/203 DS

[51] Int. Cl.[2] ..... H01R 43/04

[58] Field of Search ..... 29/203; 226/68

[56] References Cited

UNITED STATES PATENTS

| | | | |
|---|---|---|---|
| 2,681,447 | 6/1954 | Davis | 29/203 |
| 3,266,695 | 8/1966 | Cervenka et al. | 29/203 |
| 3,376,627 | 4/1968 | Sitz | 29/203 |
| 3,390,567 | 7/1968 | Frastaci | 29/203 |
| 3,416,213 | 12/1968 | Cootes | 29/203 |
| 3,548,479 | 12/1970 | Netta et al. | 29/203 |

*Primary Examiner*—Lowell A. Larson

*Attorney, Agent, or Firm*—D. R. Bair; F. M. Arbuckle

[57] ABSTRACT

Apparatus and method for crimping electrical terminals in strip form wherein a head operates in a down stroke to move a crimping die toward an anvil to crimp a terminal to a conductor, to shear off the terminal and to move a cam against a cam roller on a carriage block to move the carriage block away from the crimping die and anvil, against the force of a compression spring, a feed blade pivotally supported on the block being then moved rearwardly along a terminal strip carrier portion. In the upstroke of the head, the carriage block moves into engagement with a stop screw, the feed blade being engaged in an aperture in the terminal strip carrier portion to move a terminal to a crimping position. Drag means are provided to prevent reverse movement of the terminal strip and guide means are provided including an elongated element engageable with terminal projections. The stop screw and guide element are readily adjustable to obtain accurate positioning of a terminal in the crimping means and accurate feed of the terminal strip. In the preferred embodiment, a number of different terminal strips with different spacing (within a 2:1 ratio) between the terminals, but having a standardized distance from an aperture to a terminal can be processed without major adjustment in the apparatus. This is accomplished by initially setting the stop which determines the position of the feed blade at the extreme of its forward movement toward the crimping means, so that the blade is then at the standardized distance from the anvil of the crimping means, and providing rearward travel of the feed blade to a distance greater than the spacing between terminals of any strip to be used, and less than twice the spacing between terminals of the strip with the smallest spacing between terminals to be used.

8 Claims, 13 Drawing Figures

APPARATUS AND METHOD FOR CRIMPING TERMINALS

This is a continuation, of application Ser. No. 333,630 filed Feb. 20, 1973, now abandoned.

This invention relates to an apparatus and method for crimping electrical terminals and more particularly to an apparatus and method with which electrical terminals in strip form, of various sizes and configurations, are accurately fed to and positioned in crimping means with a high degree of reliability, the apparatus being compact, comparatively simple in construction and operation and readily adjustable according to the size and configuration of the terminal strip being processed.

BACKGROUND OF THE PRIOR ART

There are a considerable number of prior art disclosures of machines for feeding terminals in strip form and crimping the terminals to conductors. Such machines have been quite complex in construction and operation, requiring a large number of parts and being expensive to manufacture and not always reliable. For example, various types of arrangements have been provided for feeding a terminal strip to position a terminal for crimping, including fluid-actuated assemblies, usually pneumatically operated, and cam operated mechanisms and linkages for driving the strip toward the crimping means. Fluid-actuated arrangements require a source of fluid under pressure, are generally expensive and difficult to control especially with regard to controlling the speed of movement of a strip. Prior art cam operated mechanisms and linkages have been complicated and apt to get out of order.

Another disadvantage of prior art machines is that they have generally been operative only with a terminal strip of a particular size and configuration and it has not been possible to adjust such machines to accommodate widely different sizes and configurations of terminal strips. It has been necessary to replace parts or sub-assemblies with different parts or subassemblies, in such cases.

SUMMARY OF THE INVENTION

This invention was evolved with the general object of overcoming the disadvantages of prior art machines and of providing an apparatus for feeding and crimping terminals in strip form which is simple in construction and operation and which is readily adjustable to accommodate different sizes and configurations of terminal strips while being highly accurate and reliable.

Another object of the invention is to provide an improved method of feeding and crimping terminals in strip form of various sizes and configurations.

In accordance with the invention, apparatus is provided to which a terminal strip is supplied, the strip including terminals in longitudinally spaced relation along a carrier portion which has apertures spaced along the length thereof, each terminal being spaced a certain distance in a forward direction from a corresponding aperture. An engagement element is movable toward and away from crimping means and is arranged for driving engagement in an aperture of the terminal strip carrier portion which is moved during movement of the engagement element toward the crimping means to position a terminal in the crimping means. Stop means are provided for limiting movement of the engagement element toward the crimping means, the stop means being preferably adjustable according to the dimensions of the strip being processed. By stopping the engagement element at a distance from the crimping position which is equal to the forward distance of spacing of each terminal from its corresponding aperture, the terminal is accurately positioned in the crimping means. Thus, with this comparatively simple arrangement, the apparatus can be readily adjusted according to dimensional characteristics of a terminal strip being processed to effect precise positioning of terminals in the crimping means.

In accordance with specific features of the invention, the crimping means is actuatable from an initial condition through an operating stroke in which a terminal positioned therein is crimped to a conductor and then through a retraction stroke back to the initial condition and the engagement element is carried by carriage means urged by spring means toward the crimping means with drive means being engageable with the carriage means to move the carriage means away from the crimping means during the operating stroke of the crimping means and to allow movement of the carriage means toward the crimping means by the spring means during the retraction stroke of the crimping means. The stop means is positioned in the path of movement of the carriage means toward the crimping means.

With this arrangement, there is a positive drive of the carriage only in a direction away from the crimping means, the drive in the opposite direction, toward the crimping means, being accomplished by the spring means and stopping of the carriage means at exactly the right position to precisely position a terminal in the crimping means is facilitated.

The arrangement also simplifies the drive requirements. The crimping means may preferably comprise a reciprocable head carrying a crimping die to move the die toward and away from an anvil and the drive means is preferably connected to the reciprocable head to be operated therefrom. According to a specific feature, a cam is carried by the head and engages a cam-follower carried by the carriage means to move the carriage means away from the crimping means during the retraction stroke of the head.

Further features of the invention relate to the construction and support of the engagement element which is preferably in the form of a blade supported from the carriage means through a pivotal spring-urged feed finger, the blade being so formed as to engage in an aperture to positively and reliably drive the terminal strip and to be deflected so as not to drive the strip when moved away from the crimping means.

Another feature of the invention is in the provision of drag means frictionally engaged with the terminal strip to hold it in the position it reaches when the stop means is engaged and to prevent reverse movement thereof when the engagement means is moved away from the crimping means.

Still another feature relates to the provision of guide means including surfaces for engaging opposite sides and one edge of the terminal strip carrier portion and including an elongated guide element engageable with projecting portions of terminals. Preferably, the guide element is adjustable to accommodate terminal strips of various sizes and configurations.

Additional features relate to the manner of construction and assembly of the various parts in a manner such as to provide a unit which is rugged and reliable while being compact and economically manufacturable.

A still further feature relates to a method of feeding and crimping in which movement of a strip-advancing engagement element is so controlled in relation to the spacings of terminals relative to corresponding apertures of a terminal strip as to obtain proper feed with minimum effort even with wide variations in terminal spacings, within a 2:1 ratio.

This invention contemplates other objects, features and advantages which will become more fully apparent from the following detailed description taken in conjunction with the accompanying drawings.

DESCRIPTION OF A PREFERRED EMBODIMENT

Figure 1:
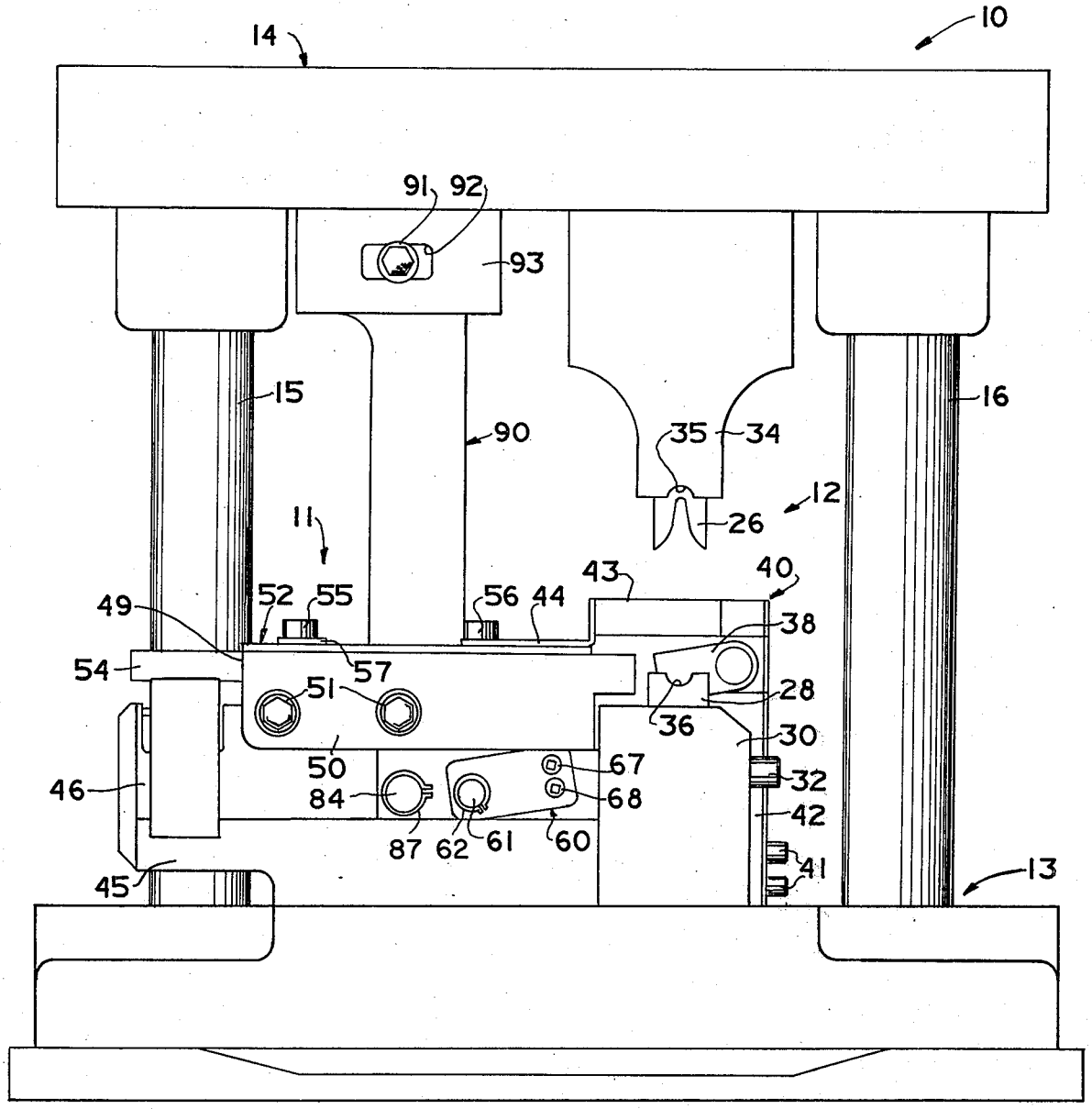
FIG. 1 is a front elevational view of apparatus for feeding and crimping terminals, constructed in accordance with the invention.

Reference numeral 10 generally designates apparatus for crimping electrical terminals to wire ends, constructed in accordance with the principles of this invention. In general, the apparatus 10 comprises feed means 11 arranged for sequentially feeding terminals of an elongated strip to crimping means 12 which is operative on a terminal positioned therein to crimp the terminal to a wire end.

The apparatus 10 includes a stationary base 13 and a vertically reciprocable head 14 which is journaled on a pair of upright posts 15 and 16 projecting upwardly from the base 13. The crimping means 12 includes elements on the base 13 and the head 14 which coact during each downstroke of the head 14 and the feed means is operative during each upstroke of the head 14, being conditioned for such operation during the preceding down-stroke in accordance with an important feature of the invention as hereinafter described in detail.

Suitable means, not shown, are provided for effecting a down stroke of the head 14 from an upper initial position, shown in FIG. 1, to a predetermined lowermost position and then back through the upstroke to the initial position. By way of example, the head 14 may be connected through a connecting rod to a crank rotated about a horizontal axis and driven through a one-revolution clutch from an electrical drive motor, actuation of the clutch being effective to cause one downstroke of the head 14 and then an upstroke thereof to the initial position.

Figure 2:
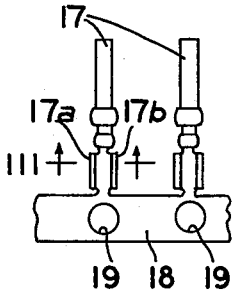
FIG. 2 is a view showing a portion of a terminal strip, including two adjacent terminals, usable with the apparatus of FIG. 1, FIG. 2 being on an enlarged scale.

FIG. 2 illustrates a pair of adjacent terminals 17 on a carrier portion 18 of a terminal strip. The carrier portion 18 has a plurality of apertures 19 along the length thereof, the spacing of the apertures 19 being equal to the spacing of the terminals 17 so that there is one aperture for each terminal.

Figure 3:
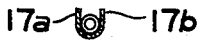
FIG. 3 is a cross-sectional view taken substantially along line III—III of FIG. 2.
Figure 4:
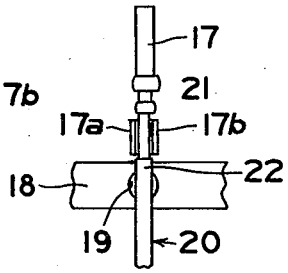
FIG. 4 illustrates the disposition of a wire end in one of the terminals shown in FIG. 2, prior to crimping.
Figure 5:
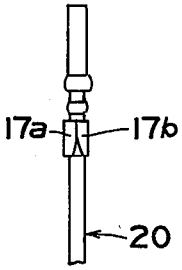
FIG. 5 shows the terminal of FIG. 4 after being crimped to the wire end and severed from a carrier portion of the terminal strip.

The terminals may have various configurations. The illustrated terminals 17 have intermediate portions of generally U-shaped cross-sectional configuration, as shown in FIG. 3, providing a pair of tabs **17*a* and 17*b*. At the crimping position, the end of a wire 20 is positioned on a terminal to extend between the tabs 17*a* and 17*b* as shown in FIG. 4, the wire 20 including a conductor 21 covered by insulation 22 with the insulation 22 being stripped to expose a short length of the conductor 21 at the end of the wire. Tabs 17*a* and 17*b* are bent inwardly in the crimping operation to tightly engage the exposed end portion of the conductor 21, as shown in FIG. 5**.

Figure 2A:
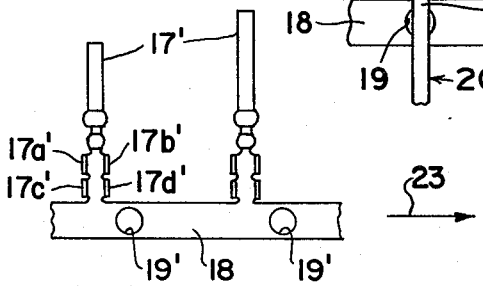
FIG. 2A is a view similar to FIG. 2, showing another type of terminal strip usable with the apparatus of FIG. 1.

FIG. 2A shows a modified terminal strip including terminals 17' on a carrier portion 18' having a plurality of apertures 19' along the length thereof. Each of the terminals 17' includes one pair of tabs **17*a*' and 17*b*' defining a wire crimping barrel and a second pair of tabs 17*c*' and 17*d*'** defining an insulation crimping barrel.

Figure 6:
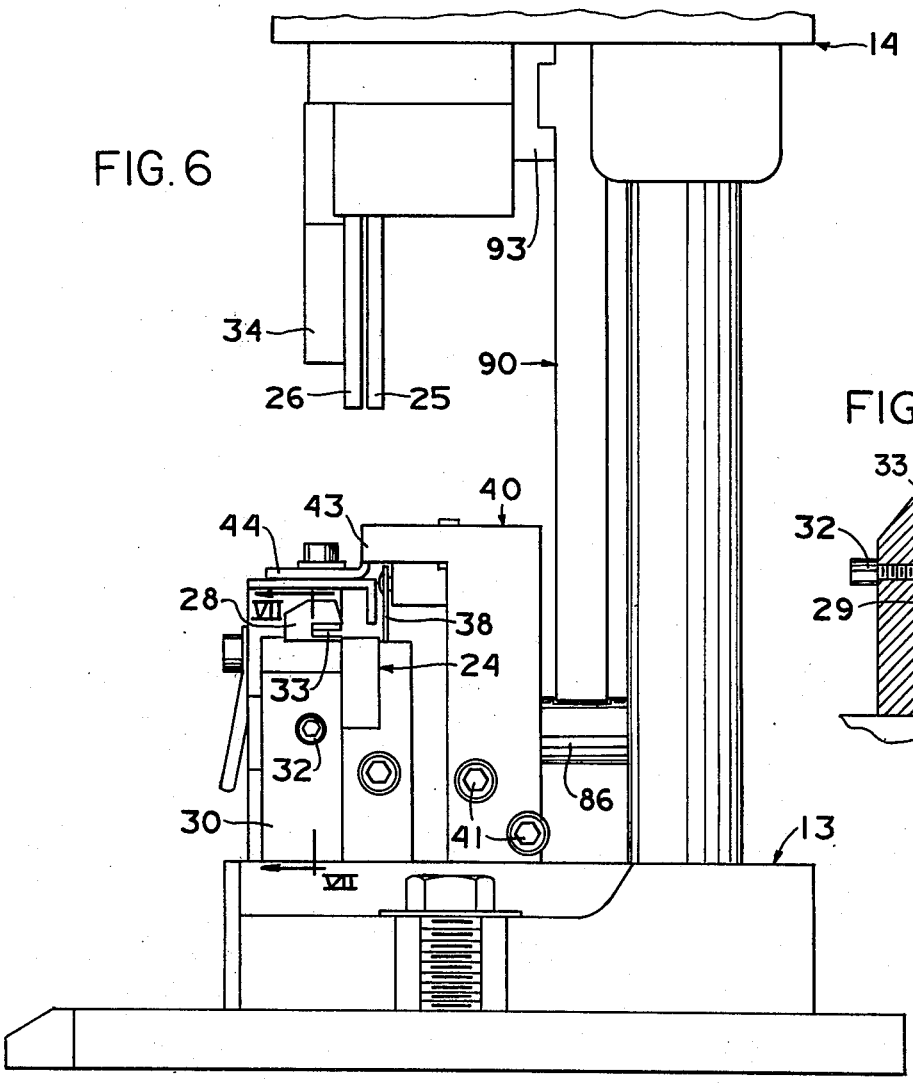
FIG. 6 is a side elevational view of the apparatus of FIG. 1.
Figure 7:
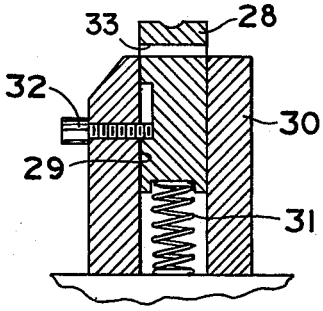
FIG. 7 is a sectional view taken substantially along line VII—VII of FIG. 6, showing a shear member and its support.
Figure 8:
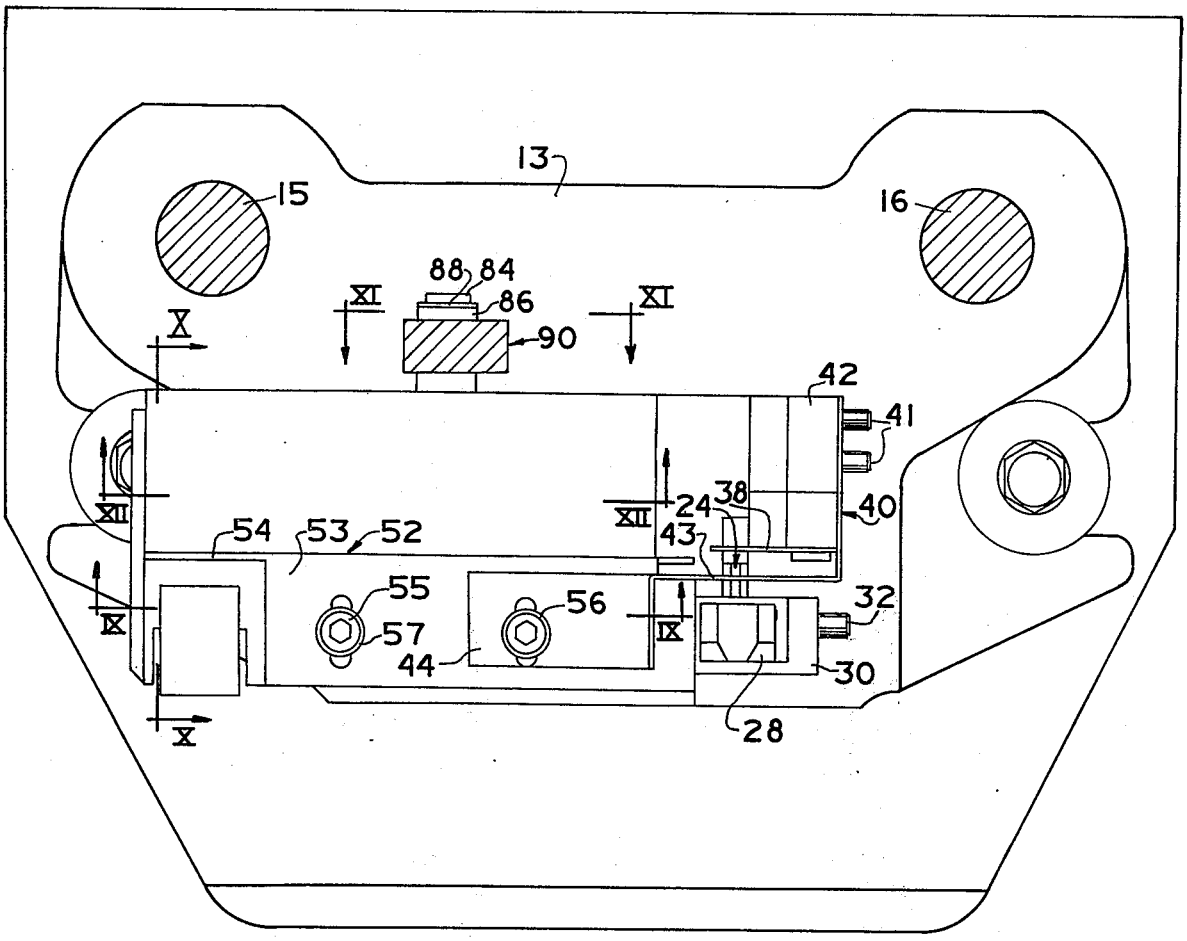
FIG. 8 is a plan view of a lower portion of the apparatus of FIG. 1.

The illustrated crimping means 12 comprises an anvil 24 (shown in the side-elevational view of FIG. 6) which is fixedly supported from the base 13, the anvil 24 being positioned to support the portion of a terminal 17 under the tabs **17*a* and 17*b* thereof. A wire crimping die 25 and an insulation crimping die 26 are carried by the head 14 in vertical alignment with the anvil 24. Each of the dies has a notch in the lower end thereof defining converging surfaces for moving the tab portions of a terminal inwardly toward each other and over a conductor or insulation during the final portion of the down-stroke of the head 14**.

Also associated with the crimping means 12 is a shear blade member 28 which is journalled for vertically reciprocable movement in a vertical guideway 29 of a support block 30 which is fixedly secured to base 13, the blade member 28 being urged upwardly by a coiled compression spring 31. The end of a screw 32 extends into a slot in the blade member 28 to limit displacement thereof, loosening of the screw 32 permitting removal of the blade member 28 for inspection or replacement.

Blade member 28 has a notch 33 in the rearward face thereof which receives a portion of a carrier strip behind a terminal positioned over the anvil 24. During a final portion of the downward movement of the head 14, the upper surface of the blade member 28 is engaged and moved downwardly by a shear blade actuator 34 carried by the head 14. The shear blade member 28 moves the portion of the carrier strip positioned in the notch 33 downwardly past the upper edges of side surfaces of the guideway 29 in block 30 and the rearward edge of the anvil 24 to shear off the portion of the carrier strip positioned in the notch 33.

The actuator 34 has a notch 35 in the lower surface thereof which cooperates with a notch 36 in the upper surface of the shear blade member to define an opening receiving and limiting displacement of the wire during the shearing operation. The notch 36 also facilitates positioning of the wire before the crimping operation, the wire being laid in the notch 36 and being pushed in until the end thereof engages a stop member 38. Stop member 38 is carried by a bracket 40 which has a portion secured by screws 41 to a post 42 on the base 13. In the illustrated arrangement, a second portion 43 of the bracket 40 extends through a space aligned with the space between the dies 25 and 26 and to a third portion 44 which is secured to the feed means 11 as described hereinafter in connection with FIG. 9.

The configuration of the elements of the crimping means may be changed according to the type of terminals to be crimped. In any case, it is essential that the terminals be accurately positioned to obtain proper operation and to obtain connections which are sound both mechanically and electrically. The feed means 11, FIGS. 9–12 is operative to achieve such positioning of the terminals with a high degree of accuracy and can be readily adjusted according to the type of terminal to be processed and the spacing of terminals and feed apertures.

The feed means 11, FIGS. 9–12 comprises a lower block 45 and an upper block 46 which are secured together and to the base 13 through suitable screws, not shown, having shank portions extending upwardly through the lower block 45 and threaded into the upper block 46. A terminal strip is disposed on the upper surface of the upper block 46, the carrier portion thereof being disposed between a portion of the upper surface of the upper block 46 and a lower surface 47 of a horizontally extending portion 48 of a front strip guide 49 of inverted L-shaped cross-section, having a vertically extending portion 50 secured against a front surface portion of the upper block 46 by a pair of screws 51. An important feature is in the provision of an adjustable guide 52 of inverted L-shaped cross-section which has a horizontally extending portion 53 disposed against the upper surface of the portion 48 of the front strip guide 49 and which has a vertically extending portion 54, extending downwardly toward the upper surface of the upper block 46. Guide portion 54 is elongated and projects to the left from the left-hand end of the portion 53, a viewed in FIG. 1.

Guide portion 54 may be so positioned as to be engageable by the forward edges of conductor crimping tabs of terminals to limit forward displacement of the terminal strip so as to obtain accurate guiding of the strip. The guide portion 54 is movable forwardly or rearwardly depending upon the dimensions of the terminals being crimped and also depending upon the configuration of the terminals. In the case of terminals having separate pairs of tabs for engagement with conductors and insulation, for example, the guide portion 54 may extend between such separate pairs of tabs. For adjustment of the position of the guide portion 54, the portion 53 is provided with a pair of slots through which a pair of screws 55 and 56 extend, threaded into the portion 48 of the front strip guide 49. A washer 57 is disposed between the head of screw 55 and the portion 53 while the portion 44 of the bracket 40 is disposed between the head of screw 56 and the portion 44 of the bracket 40, the portion 44 of the bracket 40 being thereby held in place by screw 56.

To move the terminal strip, a feed finger 60 is provided which is journalled for pivotal movement on a shaft 61, being held thereon by a retaining ring 62. Shaft 61 is carried by a carriage block 64 which is mounted in blocks 45 and 46 for reciprocable movement in a horizontal direction parallel to the direction of movement of the terminal strip. Feed finger 60 is urged in a counter-clockwise direction, as viewed in FIGS. 1 and 9, by a torsion spring 65 disposed on shaft 61 and having ends engaging the upper side of the block 45 and the feed finger 60, the feed finger 60 having a bifurcated configuration for this purpose. A feed blade 66 is carried by the finger 60, being secured thereto by screws 67 and 68 in the illustrated construction, and extends upwardly and to the right to a terminal end 70 defined by the intersection of a generally vertically extending surface portion 71 and a surface portion 72 extending angularly upwardly and to the right.

The terminal end 70 of the feed blade 66 is adapted to engage in a feed aperture of the carrier portion of a terminal strip and when the reciprocable block 64 is moved to the right, toward the crimping means, the terminal end 70 moves up and into a feed aperture and the upper end of the vertically extending surface portion 71 thereof engages the right edge of the feed aperture to move the terminal strip to the right. When the carriage block 64 is moved to the left, away from the crimping means, angularly extending surface portion 72 thereof engages the left edge of a feed aperture to cam the blade 66 downwardly so that the terminal strip is not moved to the left.

To firmly retain the terminal strip in a position to which it is moved and to insure against movement to the left when the carriage block 64 is moved to the left, drag means are provided for frictional engagement with the strip. In particular, a drag lever 74 is provided having a vertically extending portion 75 and a horizontally extending portion 76, the drag lever 74 being pivotally mounted on the upper support block 46 by a pin 77 for movement about a horizontal axis parallel to the direction of movement of a terminal strip. The horizontally extending portion 76 overlies the carrier portion of a terminal strip and is urged downwardly into firm engagement therewith by means of a coiled compression spring 78 mounted in a socket 79 in the block 46 and engaged with the portion 75 at a point spaced downwardly from the pivot axis.

Important features relate to the mounting, actuation and control of movement of the carriage block 64. Block 64 is journalled for rectilinear movement in a closed generally rectangular cavity formed by mating open cavities 81 and 82 in the upper and lower sides of the lower and upper blocks 45 and 46. A pin 84 extends horizontally through the carriage block 64 on an axis transverse to the direction of movement of the block and projects rearwardly through a slot 85 in the upper block 46, with a roller 86 being journalled on the rearward end of the pin 84, retaining rings 87 and 88 being disposed, respectively on the forward and rearward ends of the pin 84. Roller 86 is engageable by a feed cam member 90 carried from the head 14 by means including a socket head cap screw 91 which extends through a slot 92 in a member 93 depending from the head 14 and which is threaded into the upper end of the feed cam member 90. The feed cam member 90 has a lower end surface 94 extending angularly for camming engagement with the roller 86 to move the carriage block 64 to the left as viewed in FIG. 9 or to the right as viewed in FIG. 11, when the head 14 is moved downwardly.

A coiled compression spring 96 is disposed within a socket 97 in the upper base block 46 and engages the left side of the carriage block 64, to hold the roller 86 in engagement with the feed cam member and to effect movement of the carriage block 64 to the right when the head 14 is moved upwardly. Movement of the carrier block 64 to the right is limited by an adjustable stop screw 98 threaded through the right hand wall of the base block 46 and engageable with the right side of the carriage block 64.

Figure 9:
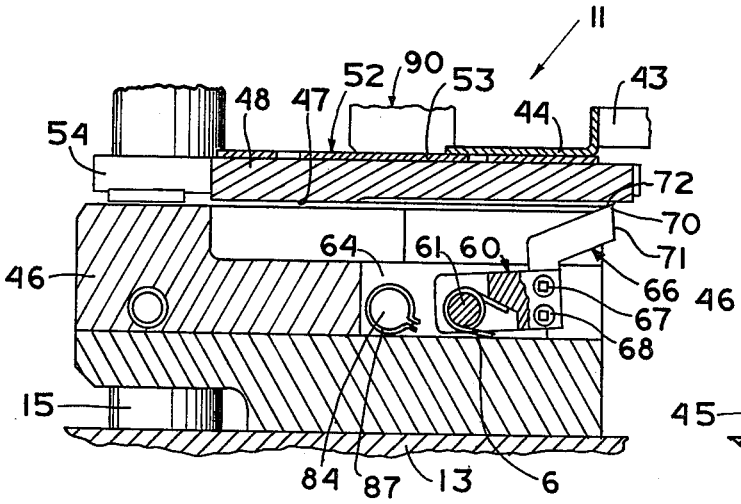
FIG. 9 is a sectional view taken substantially along line IX—IX of FIG. 8.
Figure 10:
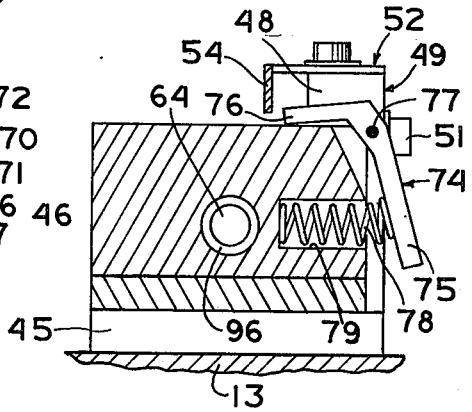
FIG. 10 is a sectional view taken substantially along line X—X of FIG. 8.
Figure 11:
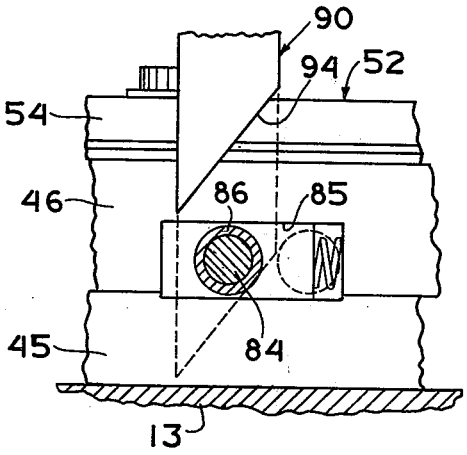
FIG. 11 is a sectional view taken substantially along line XI—XI of FIG. 8.
Figure 12:
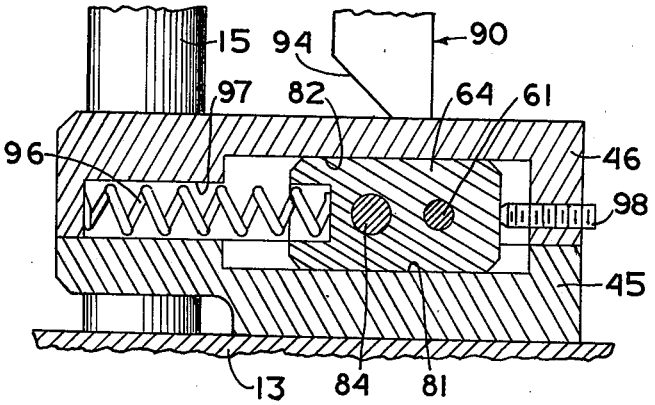
FIG. 12 is a sectional view taken substantially along line XII—XII of FIG. 8.

In operation, during the final portion of the downstroke or operating stroke of the head 14, the cam surface 94 of the feed cam member 90 engages the roller 86 to move the carriage block 64 to the left as seen in FIG. 9. At this time, the angular surface 72 of the feed blade 66 is cammed downwardly to ride under the carrier portion of a terminal strip which is firmly held in position by the drag lever 74. Also, the crimping operations are performed during the final portion of the operating stroke, on a terminal positioned between the anvil 24 and crimping dies 25 and 26. Then, during the retraction or upstroke of the head 14, the carriage block 64 is gradually moved to the right under the force of the spring 96 until the right hand end thereof engages the left end of the stop screw 98. During such movement the terminal end 70 of the feed blade 66 enters an aperture in the carrier portion of a terminal strip and moves the strip to the right.

The apparatus can be readily adjusted to accommodate terminal strips of various sizes and configurations. First, the position of the guide portion 54 of guide member 52 may be adjusted to engage projections of the terminals such as the projecting tabs 17*a* and 17*b* of the terminals 17 shown in FIG. 2. Then, the feed means 11 may be adjusted in accordance with the spacing of the terminals and the relation of the feed apertures thereto. As a first example, assume that the terminals of a particular strip have a ½-inch spacing therebetween with a feed aperture being positioned three-eighths inches rearwardly from each terminal. The relationship of terminals and apertures in this example is approximately as shown in FIG. 2A, the feed aperture which corresponds to a particular terminal being the first aperture adjacent thereto in a rearward direction. The arrow 23 indicates the forward direction of feed. The stop screw 98 is adjusted to position the terminal end 70 of the feed blade 66 at a point three-eighths inches to the left from the center line of the anvil 24 when the carriage block is against the stop screw 98. The position of the cam member 90 is adjusted, if necessary, to obtain a stroke within a certain range, the exact length not being critical. In this example, the stroke should be at least one-half inch (the distance between adjacent feed apertures) and less than 1 inch (twice the distance between adjacent feed apertures). If the stroke were less than one-half inch, the strip would not be fed and if it were 1 inch or more and less than 1½ inches, the strip would be moved 1 inch during each stroke. The position of the cam member 90 might, for example, be adjusted to obtain a distance of 15/16 inches from the terminal end of the feed blade 66 to the anvil 24 when the carriage block 64 is at the limit of its travel to the left. With this adjustment, the stroke would be fifteen-sixteenths minus three-eighths or nine-sixteenths inches. Any terminal strip having terminal spacings of from nine-sixteenths inches down to slightly greater than nine thirty-seconds inches might then be fed without any adjustments of the apparatus, so long as all the strips are made with the same constant value of ⅜ inch spacing between each terminal and a corresponding aperture rearwardly therefrom.

As a second example, assume that the terminals of a particular strip have a spacing of one-fourth inches therebetween and assume that the feed apertures are aligned with the terminals as shown in FIG. 2. The stop screw might be adjusted to position the terminal end 70 of the feed blade 66 at a point one-fourth inches from the anvil 24 and the cam member 90 might be adjusted to reduce the stroke to less than one-half inch and greater than one-fourth inch. In this particular strip the feed aperture corresponding to a particular terminal is that aligned with the preceding terminal. However, the apparatus will operate, without further adjustment, with any strip having a terminal spacing pitch in the range from one the same as the stroke value, down to one slightly more than half that value, so long as all the strips are made with the same constant value of ¼-inch spacing between each terminal and a corresponding aperture rearwardly therefrom.

As a third example, for the same strip assumed in the second example, the stop screw 98 might be adjusted to position the terminal end 70 of the blade 66 at a point one-half inch from the anvil 24. In this case, the apparatus will function without further adjustment with a range of strips having various terminal pitch spacings, provided that in all the strips, each terminal has a feed aperture spaced one-half inch rearwardly therefrom. It would not be necessary in this example to change the position of the cam member from that in the first example because in moving the stop screw to the left, the stroke would be reduced to be in the proper range for a ¼-inch terminal spacing. Example 2 would be less preferable for this reason and also because it would necessitate movement of the feed blade to a position quite close to the crimping structure.

From consideration of these examples, it can be seen that by appropriate selection of the spacings between feed apertures and corresponding terminals, it is possible to feed any terminal strip having a terminal spacing within a range of from a certain minimum to a maximum of slightly less than twice the minimum, without any adjustments. Also, it is not generally necessary to adjust the position of the feed cam member 90 and, where adjustment is required, it is not critical. The stop screw 98 is generally the only adjustment required, and it can be readily and quickly adjusted to obtain accurate positioning. In this connection, it is noted that in a setting up operation, fine adjustments may be made in the position of the stop screw 98 to obtain optimum results determined by observing trial crimping operations.

It is further noted that not only is the adjustment of the cam member not critical, but the contour of the cam surface 94 thereof is also not critical. No specially contoured cam surface is required.

It will be understood that modifications and variations may be effected without departing from the spirit and scope of the novel concepts of this invention.

I claim as my invention:

1. Apparatus for connecting conductors to electrical terminals supplied to such apparatus in the form of strips whereon said terminals are carried at uniformly spaced intervals along an elongated carrier having feed apertures formed therein and spaced along the length thereof at the same interval as said terminals, and wherein said terminals may be supplied as different strips having different uniformly spaced terminal intervals as aforesaid, but said different strips having a constant value of spacing between a terminal and a feed aperture therefor, said apparatus being capable of accepting, without adjustment, strips as described and having interval spacings from a minimum value to slightly less than twice that minimum value, said apparatus comprising: crimping means for crimping a terminal positioned therein to a conductor, and reciprocating feed means for feeding a terminal strip in a longitudinal direction to said crimping means to successively position terminals in a crimping position therein, said feed means comprising an engagement element movable in a stroke toward and away from said crimping means and arranged to engage and advance the terminal strip by entering an aperture thereof during movement of said engagement element toward said crimping means, and to release from engagement with the terminal strip during movement of said engagement element away from said crimping means, the stroke of said movement of said engagement element being slightly less than twice the length of said minimum value of interval spacing, and the position of said engagement element at the end of its stroke toward said crimping means being such as to place the aperture of the strip in which said engagement element is engaged at a distance from said crimping means the same as said aforementioned constant value of spacing.

2. Apparatus as defined in claim 1, further including stop means adjustable to limit movement of said engagement element in a direction toward said crimping means at a point where a terminal on said carrier is accurately located in a crimping position.

3. Apparatus as defined in claim 2, said crimping means being actuatable from an initial condition through an operating stroke in which a terminal positioned therein is crimped to a conductor and then through a retraction stroke back to said initial condition, and said feed means comprising carriage means carrying said engagement element, support means supporting said carriage means for movement toward and away from said crimping means, spring means urging said carriage means toward said crimping means, drive means engageable with said carriage means for moving said carriage means away from said crimping means during said operating stroke of said crimping means and for allowing movement of said carriage means toward said crimping means by said spring means during said retraction stroke of said crimping means, said stop means being disposed in the path of movement of said carriage means toward said crimping means.

4. In apparatus as defined in claim 3, guide means on said support means defining first and second planar surfaces in spaced facing relation for receiving a terminal strip carrier portion therebetween and defining a third surface for engagement by one edge of a terminal strip carrier portion.

5. In apparatus as defined in claim 4, wherein the terminals of a terminal strip project transversely from one side of a carrier portion thereof and wherein said terminals have portions projecting therefrom in a plane spaced from said one side edge, said third surface of said guide means being engageable with the opposite side edge of a terminal strip carrier portion, said guide means further including an elongated guide element disposed in a plane in spaced parallel relation to said third surface and engageable with said projecting portions of said terminals to cooperate with said first, second and third surfaces in guiding a terminal strip.

6. In apparatus as defined in claim 5, means adjustably mounting said guide element for adjusting the distance therefrom to said third surface.

7. In apparatus as defined in claim 3, said carriage means comprising a generally rectangular block, said support means comprising block means defining a generally rectangular chamber receiving said carriage block, said spring means comprising a coiled compression spring in said support block means engaging one end of said carriage block, and said stop means comprising a screw threaded through one wall of said support block means and engageable with the opposite end of said carriage block.

8. A method for connecting conductors to electrical terminals utilizing strips whereon said terminals are carried at uniformly spaced intervals along an elongated carrier having feed apertures formed therein and spaced along the length thereof at the same interval as said terminals, and wherein said terminals may be supplied as different strips having different uniformly spaced terminal intervals as aforesaid within a 2:1 ratio, but said strips having a constant value of spacing between a terminal and a feed aperture therefor, said method consisting of 1. Advancing a strip of terminals as aforesaid toward a crimping means, by means of a blade engaged in one of said feed apertures,
2. Stopping the advance of said strip at a point where said blade is at a distance from said crimping means equal to said constant value of spacing,
3. Actuating said crimping means to crimp onto a conductor the terminal which is located at said constant value of spacing from the feed aperture in which said blade is then engaged,
4. Holding said strip against retraction, and
5. Retracting said blade in a direction away from said crimping means by an amount at least as great as the interval spacing between terminals on any strip to be used, and less than twice the minimum value of interval spacing on any strip to be used.

* * * * *